US005577905A

United States Patent [19]

Momber et al.

[11] Patent Number: 5,577,905

[45] Date of Patent: Nov. 26, 1996

[54] FUEL CONTROL SYSTEM, PARTS THEREFOR AND METHODS OF MAKING AND OPERATING THE SAME

[75] Inventors: Gregory J. Momber, Grand Rapids; Dwain F. Moore, Holland, both of Mich.

[73] Assignee: Robertshaw Controls Company, Richmond, Va.

[21] Appl. No.: 340,527

[22] Filed: Nov. 16, 1994

[51] Int. Cl.[6] ..... F23N 5/00

[52] U.S. Cl. ..... 431/66; 431/72; 431/46; 431/78

[58] Field of Search ..... 431/25, 66, 72, 431/73, 74, 46, 78

[56] References Cited

U.S. PATENT DOCUMENTS

| | | | |
|---|---|---|---|
| 4,836,770 | 6/1989 | Geary | 431/46 |
| 4,856,983 | 8/1989 | Geary | 431/27 |
| 4,871,307 | 10/1989 | Harris et al. | 431/25 |
| 4,971,549 | 11/1990 | Geary | 431/46 |
| 4,976,605 | 12/1990 | Geary | 431/27 |
| 5,141,431 | 8/1992 | Geary | 431/6 |
| 5,209,655 | 5/1993 | Geary | 431/6 |
| 5,348,466 | 9/1994 | Momber | 431/6 |

*Primary Examiner*—Carroll B. Dority
*Attorney, Agent, or Firm*—Fulbright & Jaworski, LLP

[57] ABSTRACT

A fuel control system, parts therefor and methods of making and operating the same are provided, the fuel control system comprising an ignition unit for igniting fuel issuing from a burner, and a flame detecting unit for detecting flame at the burner, the flame detecting unit comprising a sensing device for receiving an electrical signal caused by flame rectification at the burner, and an output device for cycling the signal to the sensing device in an on and off manner in each cycle of operation of the output device, the control system having a modulating unit for modulating the on time and the off time of the output device in each cycle of operation thereof.

22 Claims, 5 Drawing Sheets

FUEL CONTROL SYSTEM, PARTS THEREFOR AND METHODS OF MAKING AND OPERATING THE SAME

BACKGROUND OF THE INVENTION

1. Field of the Invention

This invention relates to a new fuel control system and to new parts for such a fuel control system as well as to new methods of making and operating such a fuel control system and to new methods of making such parts.

2. Prior Art Statement

It is known to provide a fuel control system for a burner means and comprising ignition means for igniting fuel issuing from the burner means, and flame detecting means for detecting flame at the burner means, the flame detecting means comprising a sensing means for receiving an electrical signal means caused by flame rectification at the burner means, and an output means for cycling the signal means to the sensing means in an on and off manner in each cycle of operation of the output means, the output means being cycled by an AC source. For example, see the Momber U.S. Pat. No. 5,348,466.

SUMMARY OF THE INVENTION

It is one of the features of this invention to provide a new fuel control system wherein the duty cycle of the output means of the flame detecting means thereof is uniquely modulated to not only detect the presence of flame sense current but to also quantify the amount of flame sense current.

In particular, the aforementioned prior known fuel control system cycled the output means with a 50/60 Hz sine wave so that basically the output means would be on at a 50% duty cycle.

In contrast, this invention provides modulating means to modulate the on time and the off time of the output means in each cycle of operation thereof and this pulse width modulation can provide for consistent flame failure response time under varying conditions, very fast flame failure response time, and the aforementioned quantification of the flame sense current.

For example, one embodiment of this invention comprises a fuel control system for a burner means and comprising ignition means for igniting fuel issuing from the burner means, and flame detecting means for detecting flame at the burner means, the flame detecting means comprising a sensing means for receiving an electrical signal means caused by flame rectification at the burner means, and an output means for cycling the signal means to the sensing means in an on and off manner in each cycle of operation of the output means, the control system having modulating means for modulating the on time and the off time of the output means in each cycle of operation thereof.

Accordingly, it is an object of this invention to provide a new fuel control system having one or more of the novel features of this invention as set forth above or hereinafter described.

Another object of this invention is to provide a new method of making such a fuel control system, the method of this invention having one or more of the novel features of this invention as set forth above or hereinafter shown or described.

Another object of this invention is to provide a new method of operating such a fuel control system, the method of this invention having one or more of the novel features of this invention as set forth above or hereinafter shown or described.

Another object of this invention is to provide a new part for such a fuel control system, the new part of this invention having one or more of the novel features of this invention as set forth above or hereinafter shown or described.

Another object of this invention is to provide a new method of making such a new part, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 2A illustrates a part of the new fuel control device of this invention.

FIG. 2B illustrates another part of the new fuel control device of this invention.

FIG. 2C illustrates another part of the new fuel control device of this invention.

FIG. 2D illustrates another part of the new fuel control device of this invention.

DESCRIPTION OF THE PREFERRED EMBODIMENT

Figures 1, 2A:
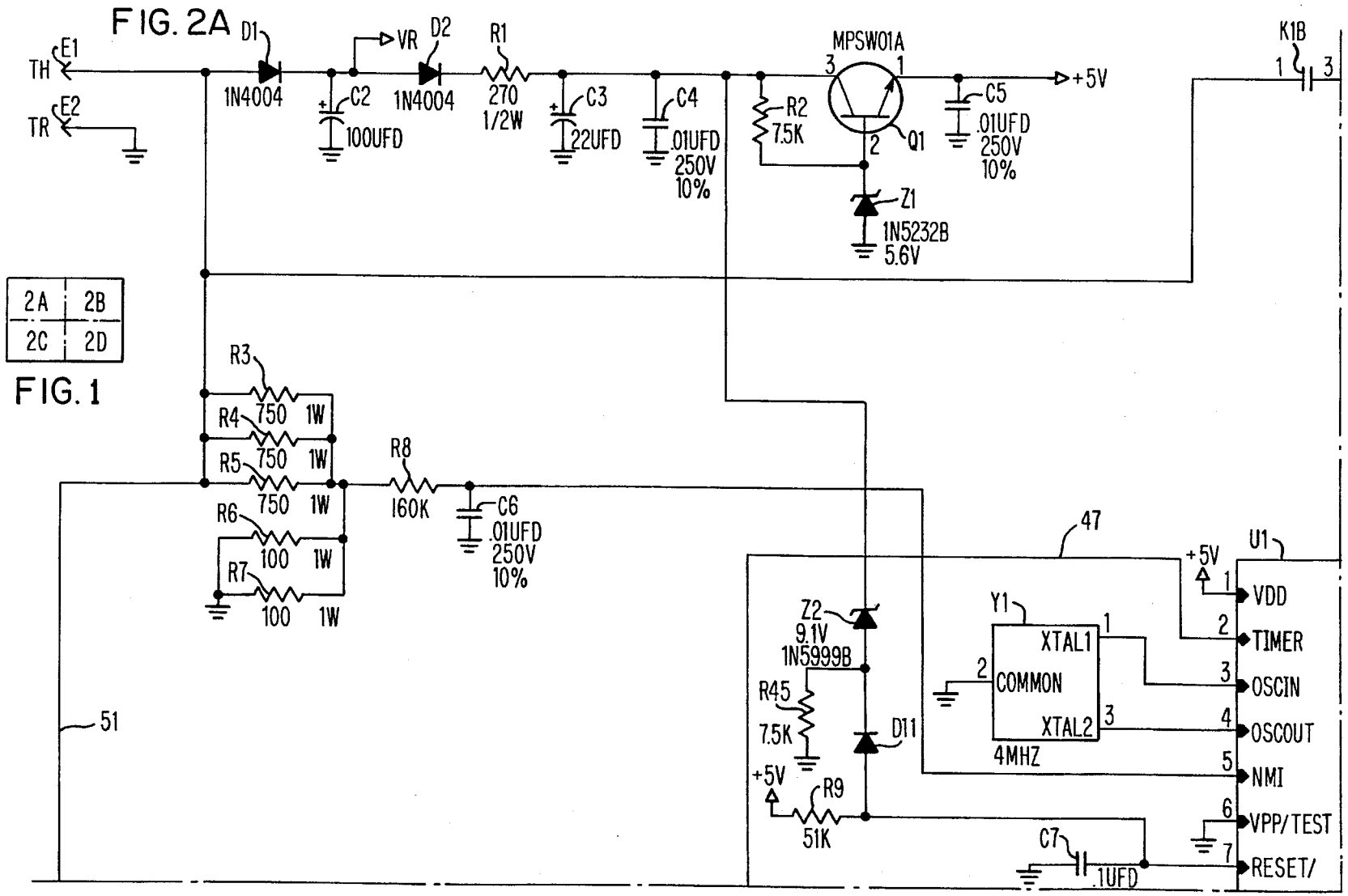
FIG. 1 is a block diagram illustrating how
FIGS. 2A–2D are to be positioned together to provide the new control device of this invention that forms part of the new fuel control system of this invention that is schematically illustrated in FIG. 3.

While the various features of this invention are hereinafter illustrated and described as being particularly adapted to provide a fuel control system for a furnace, it is to be understood that the various features of this invention can be utilized singly or in various combinations thereof to provide a fuel control system for other apparatus as desired.

Therefore, this invention is not to be limited to only the embodiment illustrated in the drawings, because the drawings are merely utilized to illustrate one of the wide variety of uses of this invention.

Figure 2B:
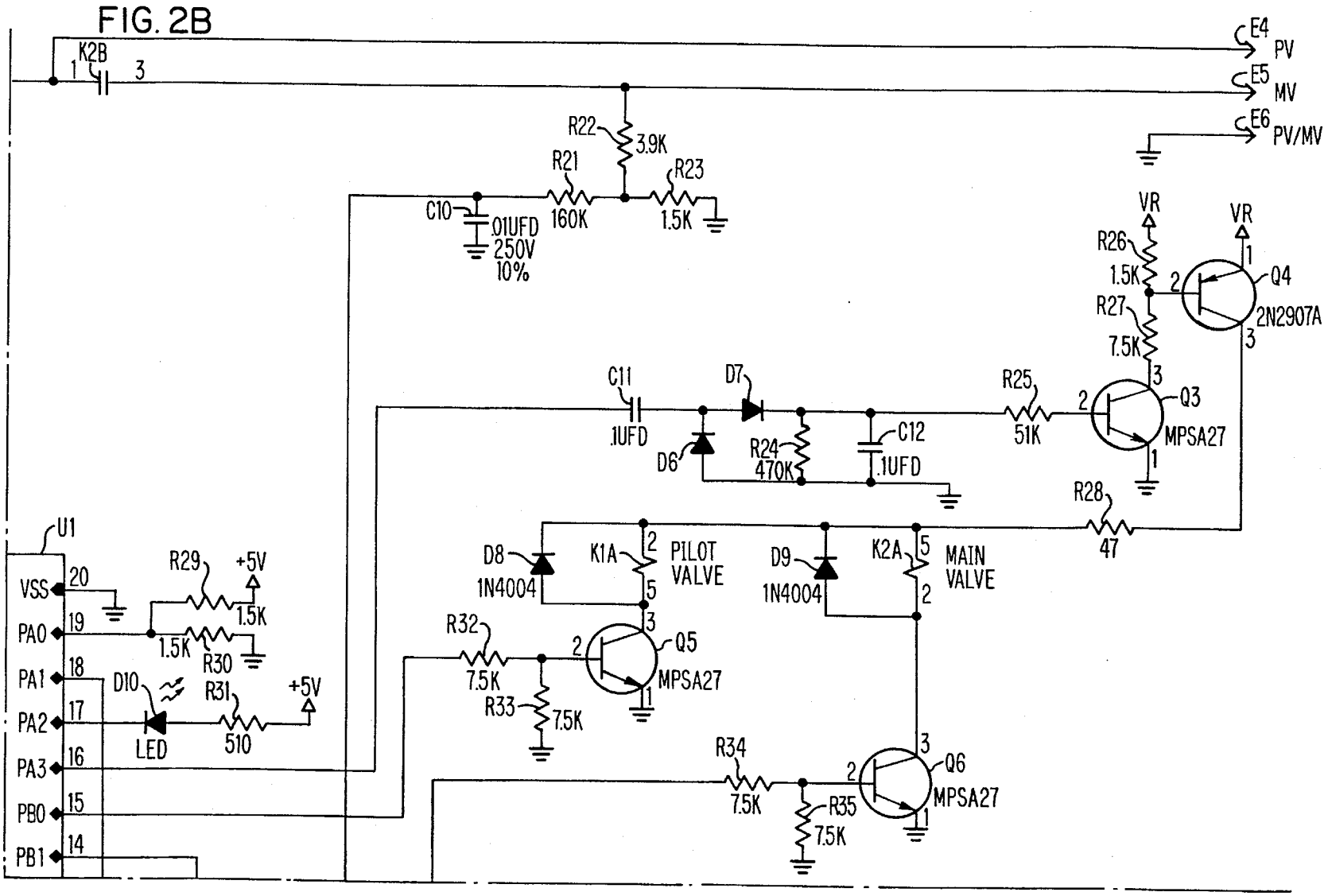
Figure 2C:
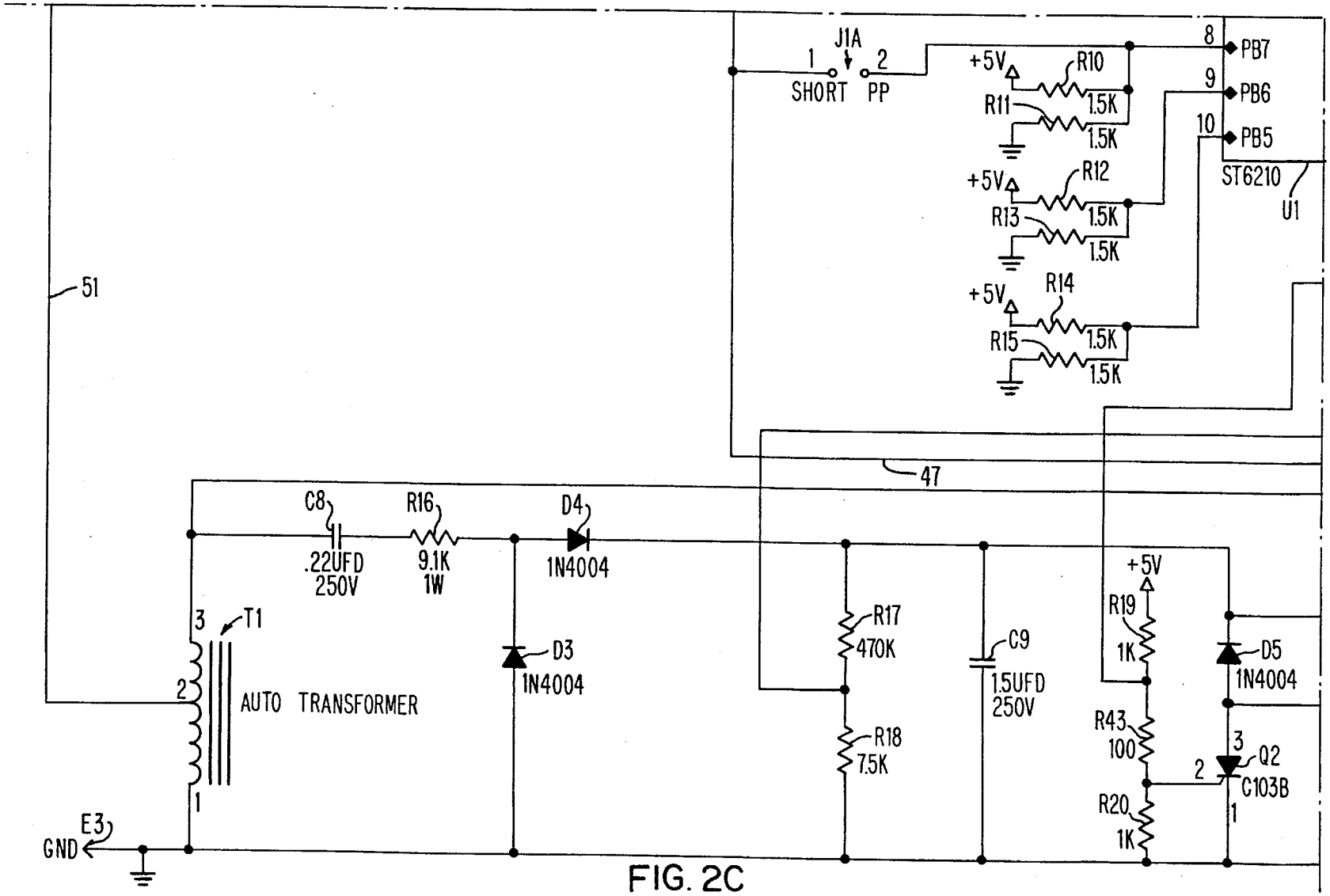
Figure 2D:
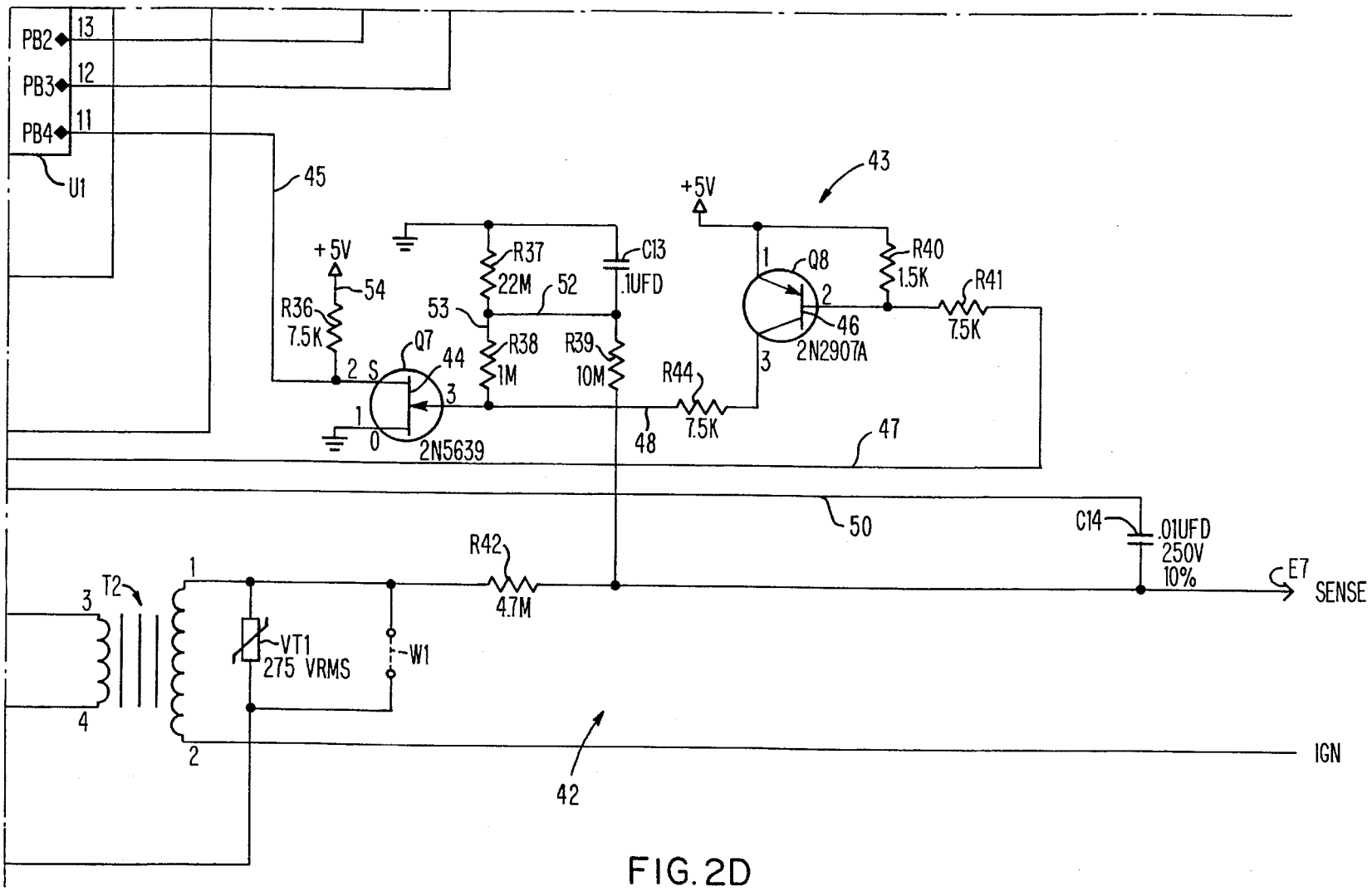
Figure 3:
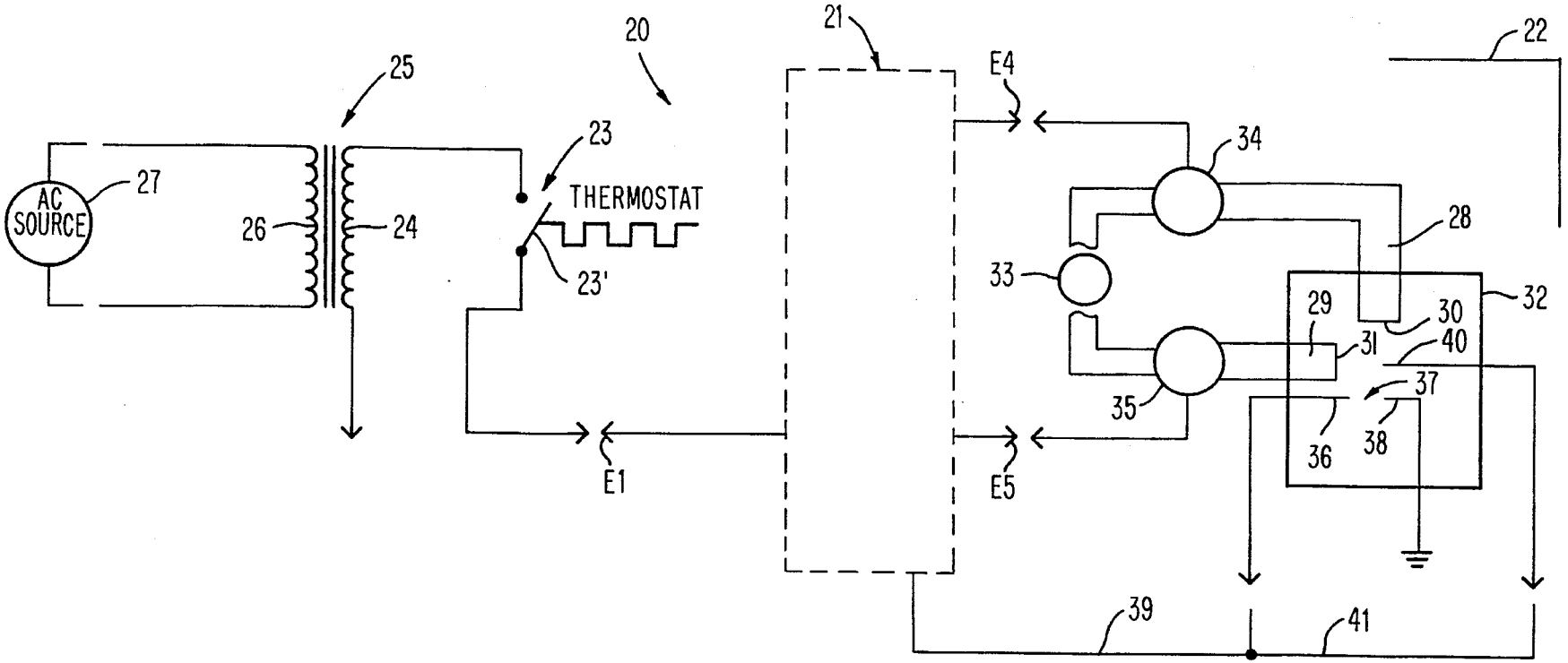
FIG. 3 is a schematic view and illustrates the new fuel control system of this invention that utilizes the new fuel control device of FIGS. 2A–2D.

Referring now to FIG. 3, the new fuel control system of this invention is generally indicated by the reference numeral 20 and comprises a new control device of this invention that is generally indicated by the reference numeral 21, the electrical circuit means and electrical components of the control device 21 being illustrated in detail in FIGS. 2A–2D with the various components thereof being respectively indicated by reference characters that are common in the art to represent the component such as capital C for a capacitor, R for a resistor, D for a diode, Q for a transistor, etc. with each capital letter thus being followed by a numeric number to distinguish that particular reference letter from the others of a similar component. Therefore, only the components believed necessary to fully understand the various features of this invention in FIGS. 2A–2D will be hereinafter specifically mentioned with the understanding that since the other components not specifically mentioned and the electrical interconnections of the components are all elements that are well known in the art, a specific explanation thereof to a person skilled in the art is not needed.

Further, unless otherwise specified in the drawings, all resistor values thereof are in ohms, 0.25 watt, plus/minus 5%, all capacitor values are 50V, plus/minus 20% and all diodes are 1N4148.

The control system 20 illustrated in FIG. 3 is being utilized to control the operation of a gas burning furnace that is represented by the reference numeral 22 in FIG. 3, the control system 20 further comprising a room thermostat 23 that closes an electrical switch 23' thereof when sensing a temperature below the set point temperature of the thermostat 23 and thereby interconnects a secondary coil means 24 of a transformer 25 to a terminal E1 that forms part of the control device 21 as illustrated in FIG. 2A. The transformer 25 has a primary coil means 26 that is interconnected to an alternating current source 27 in a conventional manner.

The fuel control system 20 of this invention also comprises a pilot burner means 28 and a main burner means 29 respectively having outlets 30 and 31 disposed in a combustion chamber 32 of the furnace 22 and being adapted to be supplied fuel from a fuel source 33 through respective electrically operated valve means 34 and 35 that are electrically interconnected to terminals E4 and E5 of the fuel control device 21 as illustrated in FIG. 2B.

As illustrated in FIG. 3, an igniter electrode 36 is disposed in the combustion chamber 32 and forms a spark gap 37 from a grounded electrode 38 so that when the control device 21 energizes the electrode 36 in a manner well known in the art, sparking is created across the spark gap 37 which is adapted to ignite fuel issuing from the outlet end 30 of the pilot burner means 28 all in a manner well known in the art. For example, see the aforementioned Momber U.S. Pat. No. 5,348,466 as well as the Geary U.S. Pat. Nos. 4,836,770; 4,856,983; 4,971,549; 4,976,605 and 5,141,431 whereby these five Geary U.S. patents and the one Momber U.S. patent are all being incorporated into this disclosure by this reference thereto.

When the electrode 36 is being utilized as a local sensor for detecting flame at the pilot burner means 28 through flame rectification in a manner well known in the art, the electrical signal generated by such flame rectification is interconnected to the control device 21 through an electrical line or lead means 39 to be utilized in a manner hereinafter set forth. Similarly, should a remote flame detecting electrode 40 be utilized to sense flame through flame rectification with the pilot burner means 28, the electrical signal being generated at the remote sensor 40 is interconnected to the line 39 of the fuel control device 21 by a line or lead means 41 as illustrated in FIG. 3.

The control device 21 of this invention comprises a microcomputer or microprocessor U1 illustrated in FIGS. 2A–2D and being uniquely utilized to determine the amount of electrical current being created through the aforementioned flame rectification with the pilot burner means 28 for the aforementioned unique functions as will be apparent hereinafter.

The control system 20, in general, operates in a manner well known in the art whereby when the thermostat 23 closes the switch 23' because the thermostat 23 is sensing a temperature below the set point temperature of the thermostat 23 and thereby determines that the furnace 22 should be in an on condition thereof, the closed thermostat 23 interconnects the alternating current of this secondary coil means 24 of the transformer 25 to the control device 21 at the terminal E1 thereof so that the microcomputer U1 turns on the transistor Q5 of FIG. 2B to energize the relay coil K1A and thereby close the relay contacts K1B of FIG. 2A to apply the electrical current at the terminal E1 to the terminal E2 of FIG. 2B and, thus, to the pilot valve means 34 of FIG. 3 so as to issue fuel from the fuel source 33 out through the outlet 30 of the pilot burner means 28.

The closing of the thermostat 23 also causes operation of a transformer T2, FIG. 2D, so that an ignition portion 42, FIG. 2D, of the control device 21 will energize the electrode 36 to cause sparking at the spark gap 37 to ignite the fuel now issuing from the pilot burner means 28.

The control device 21 has flame detecting means that is generally indicated by the reference numeral 43 in FIG. 2D for detecting flame at the pilot burner means 28 and comprises a sensing means Q7 which in the embodiment illustrated in FIG. 2D comprises a field effect transistor having a gate 44 and one pin 1 thereof interconnected to ground and the other pin 2 thereof interconnected to pin 11 of the microcomputer U1 by a conductive line or lead means 45.

The flame detecting means 43 also comprises an output means Q8 which in the embodiment illustrated in FIG. 2D comprises a driving transistor which has a gate 46 interconnected by a conductive line or lead means 47 to a timer port or pin 2 of the microcomputer U1 as illustrated in FIGS. 2A and 2C for a purpose hereinafter described, a collector of the driving transistor Q8 at pin 3 thereof being interconnected by a conductive line or lead means 48 to the gate pin 3 of the field effect transistor Q7 for a purpose also hereinafter set forth.

It is to be understood that while a transistor Q8 has been provided, it is believed that the same could be replaced by a CMOS microcomputer output. However, the advantage of using a transistor is that it allows a field effect transistor to be used therewith, which requires a negative voltage to operate the same, and because there are no negative voltages on the control device 21 of this invention, the only way a negative voltage can be produced is to truly have flame rectification, i.e. flame present for detection. This is an additional level of safety built into the control device 21 of this invention. However, the advantage of a CMOS microcomputer port is basically cost and availability.

The basic components of the control device 21 of this invention utilized for flame rectification are illustrated in FIG. 2D and comprise a capacitor C14, a capacitor C13, a resistor R39 and a conductive line or lead means 50 which provides an AC line voltage from the transformer T1 of FIG. 2C which is electrically interconnected to the thermostat terminal E1 by a conductive line or lead means 51 as illustrated in FIGS. 2A and 2C.

When flame is not present at the remote sense electrode 40 (or the igniter electrode 36 when used in local sense) the voltage across the capacitor C13 is an average of 0 volts DC since the capacitor C13 and the resistor R39 from a low pass filter for the AC. When flame is present at the remote sensor 40 (or the local sensor 36) it basically looks like a diode (cathode tied to ground) and a high resistance in series. When this condition occurs, current will flow from conductive line or lead means 50 through the capacitor C14, and the flame. The amount of current that flows is basically dependent upon the flame resistance. This will cause the capacitor C14 to start to develop a positive DC voltage (when measured from the terminal E7 to the lead means 50) during the positive portion of the AC sine wave, the capacitor C13 will see a more negative voltage (peak sine voltage plus the voltage of the capacitor C14). This occurs 60 times a second and at each positive cycle the capacitor C14 will develop a more positive voltage and this process will eventually cause a negative voltage to develop across the capacitor C13. This negative voltage is applied to the gate 44 of the field effect transistor 27 through conductive lines or lead means 52, 53 and 48 and causes the field effect transistor Q7 to turn off when such negative voltage exceeds the gate-source threshold voltage of the field effect transistor Q7. When the field effect transistor Q7 is turned "off", a resistor R36 that is interconnected to the positive five volt source by a conductive line or lead means 54 pulls pin 11 on the microcomputer U1 high (1) indicating the presence of a negative voltage on the gate 44 of the field effect transistor Q7 so that the microcomputer U1 now knows that the presence of a flame at the pilot burner means 28 has been detected.

As previously stated, the driving transistor Q8 is driven by the microcomputer U1 through the conductive line or lead means 47 so that the duty cycle of the transistor Q8 can be varied or modulated (pulse width modulated) by a timing means of the microcomputer U1 with the result that the microcomputer U1 determines the length of the on time and the length of the off time of the driving transistor Q8 in each cycle of operation thereof and thereby determines the length of time that the negative voltage is to be applied to the gate 44 of the field effect transistor Q7 and the length of the time that the gate 44 of the field effect transistor 27 is effectively interconnected to ground on each cycle of operation of the driving transistor Q8.

As illustrated in FIG. 2D, the resistor R37 is used to discharge the capacitor C13 when the electrical power is off or during the off time of the driving transistor Q8. A resistor R40 is merely utilized as a pull up resistor for the driving transistor Q8 and a resistor R41 is utilized as a base current limiting resistor for the driving transistor Q8. Thus, it can be seen that the driving transistor Q8 is being utilized as a switch in an unconventional manner. When the driving transistor Q8 is "on" a positive voltage is applied to the gate 44 of the field effect transistor Q7 and hence causes the field effect transistor's gate source diode to be forward biased at about +0.6 volts. A resistor R44 is utilized to limit the current through the driving transistor Q8 and the field effect transistor Q7. When the driving transistor Q8 is "on", the capacitor C13 discharges through the resistor R38 and the field effect transistor's gate source diode and back to ground. The microcomputer U1 then can vary the duty cycle of the driving transistor Q8 to try to maintain a net negative voltage on the capacitor C13 equal to the threshold voltage of the field effect transistor Q7 and it is this process that allows the microcomputer U1 to quantify the amount of the flame resistance.

In particular, the microcomputer U1 modulates the duty cycle of the driving transistor Q8 in order to tend to maintain a constant negative voltage on the gate 44 of the field effect transistor Q7 at just above the threshold voltage (pinch off voltage) of the field effect transistor Q7 and in the one working embodiment of this invention as illustrated in the drawings, the threshold voltage of the field effect transistor Q8 is approximately minus 5 volts.

In such one working embodiment of this invention, the pulse width of one cycle of operation of the driving transistor Q8 is approximately 120 milliseconds so that when no flame exists at the pilot burner means 28, the microcomputer U1 maintains the on time of the driving transistor Q8 for approximately 116 milliseconds and the off time thereof for approximately 4 milliseconds. Of course, at this time, no negative voltage will appear on the gate 44 of the field effect transistor Q7 that would turn off the field effect transistor Q7 to permit a high signal on the pin 11 of the microcomputer U1 which is necessary before the microcomputer U1 will turn on the transistor Q6, FIG. 2B, in order to energize the main valve relay coil K2A so as to close the relay contacts K2B and thus energize the main burner valve 35 to issue fuel from the outlet 31 of the main burner 29 which is ignited by the flame at the pilot burner 28.

However, when flame does appear at the outlet 30 of the pilot burner means 28, the microcomputer U1 will adjust the duty cycle of the driving transistor Q8 so as to be "on" for approximately 100 milliseconds in each cycle of operation thereof when the flame at the pilot burner means 28 is at the smallest size thereof to effect a high signal at the pin 11 of the microcomputer U1 and sets or adjusts the duty cycle of the driving transistor Q8 so as to be on for approximately 4 milliseconds in each cycle of operation thereof when the size of the flame at the pilot burner means 28 is at the largest size thereof, as this will cause the field effect transistor Q7 to provide a high signal on the pin 11 of the microcomputer U1 to indicate the presence of a flame. Thus, it can be seen that the flame failure response time provided by the flame detection means 43 of this invention is the same time regardless of whether a small flame is provided or a large flame is provided and this is important because in the United States, flame failure response time of a furnace control should be less than 0.8 seconds and in Europe the flame failure response time should be less than approximately 1 second.

Thus, it can be seen that the pulse width modulation feature of this invention will compensate for small or large flame signals, compensate for different pinch off values of the field effect transistor Q7 as well as for other component variations, and make flame recognition time as fast as possible, such features not being provided by the prior known non-modulated duty cycle of the driving transistor Q8.

In this manner, each time the thermostat 23 closes, the microcomputer U1 begins to operate the driving transistor Q8 with an "on" time of a certain long length in each cycle of operation thereof and if flame is detected in the manner previously described, the microcomputer U1 keeps reducing the length of the on time of the driving transistor Q8 a certain fixed amount after each flame recognition signal provided by the field effect transistor Q7 to the microcomputer U1 until the decreased on time of the driving transistor Q8 provides a negative voltage on the gate 44 of the field effect transistor Q7 that is just slightly above the threshold voltage thereof so as to provide a signal on the pin 11 of the microcomputer U1 whereby the microcomputer now knows the value of the electrical current being sensed and thereby knows the size of the flame at the pilot burner means 28.

The microcomputer U1 can be programmed in such a manner that the same will store or log the amount of flame sense current being detected each time the pilot burner 28 is operated for future comparison purposes to support adaptability and this data could be made available to a field service technician for trouble shooting and could also inform the user if the control device is operating below specified flame sense current.

It is to be understood that while a field effect transistor Q7 has been provided by the circuit means of this invention, it is believed that the same could be replaced with a CMOS gate or the input of a CMOS microcomputer. However, the advantage of using a field effect transistor is that the field effect transistor requires a negative voltage to operate and because there are no negative voltages on the control device 21 of this invention, the only way a negative voltage can be produced is to truly have flame rectification, i.e. flame present for detection. This is an additional level of safety built into the control device 21 of this invention. However, the advantage of a CMOS gate is basically cost and availability.

Thus, the control device 21 of this invention maintains fuel flowing to the pilot burner means 28 and the main burner means 29 as long as the fuel control device 21 is determining that a flame is present at the pilot burner means 28 and the thermostat 23 remains closed during that cycle of operation of a furnace 22. However, should flame disappear from the pilot burner means 28 for any reason, the microcomputer U1 closes the valve means 34 and 35 so as to terminate the flow of fuel to the pilot burner means 28 and 29. Also, should the thermostat 23 open because the temperature being sensed thereby is now at or slightly above the set point temperature of the thermostat 23, the microcomputer U1 likewise terminates the operation of the fuel control valve means 34 and 35 so that no fuel can issue from the pilot burner means 28 and main burner means 29 until the thermostat 23 again closes on a demand for heat from the furnace 22 in a conventional manner.

In view of the above, it can be seen that this invention not only provides a new fuel control system and new parts for such a fuel control system, but also this invention provides a new method of operating such a fuel control system and new methods of making such a fuel control system and such new parts for such a fuel control system.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a fuel control system for a burner means and comprising ignition means for igniting fuel issuing from said burner means, and flame detecting means for detecting flame at said burner means, said flame detecting means comprising a sensing means for receiving an electrical signal means caused by flame rectification at said burner means, and an output means for cycling said signal means to said sensing means in an on and off manner in each cycle of operation of said output means, the improvement wherein said control system has modulating means for modulating the on time and the off time of said output means in each cycle of operation thereof.

2. A fuel control system as set forth in claim 1 wherein said modulating means comprises a microcomputer means.

3. A fuel control system as set forth in claim 2 wherein said output means comprises a driving transistor for cycling said signal means.

4. A fuel control system as set forth in claim 3 wherein said sensing means comprises a field effect transistor having a gate that receives said signal means.

5. A fuel control system as set forth in claim 4 wherein said driving transistor has a collector electrically interconnected to said gate of said field effect transistor and has a gate electrically interconnected to said microcomputer means so as to be modulated thereby.

6. A fuel control system as set forth in claim 2 wherein said microcomputer means is operatively interconnected to said sensing means and has burner control means to maintain a flow of fuel to said burner means as long as said sensing means is detecting flame at said burner means.

7. A fuel control system as set forth in claim 2 wherein said microcomputer means is operatively interconnected to said sensing means and has quantifying means to determine the value of the electrical current of said signal means being sent to said sensing means and thereby determine the size of the flame at said burner means at that time.

8. A fuel control system as set forth in claim 7 wherein said microcomputer means has means to store the determined values of the electrical currents of said signal means for future use of such information.

9. A fuel control system as set forth in claim 1 wherein said ignition means comprises means to cause electrical sparking at said burner means.

10. A fuel control system as set forth in claim 9 wherein said burner means comprises a pilot burner means for a main burner means.

11. In a fuel control device for controlling the operation of a burner means, said device comprising ignition means for igniting fuel issuing from said burner means, and flame detecting means for detecting flame at said burner means, said flame detecting means comprising a sensing means for receiving an electrical signal means caused by flame rectification at said burner means, and an output means for cycling said signal means to said sensing means in an on and off manner in each cycle of operation of said output means, the improvement wherein said control device has modulating means for modulating the on time and the off time of said output means in each cycle of operation thereof.

12. A fuel control device as set forth in claim 11 wherein said modulating means comprises a microcomputer means.

13. A fuel control device as set forth in claim 12 wherein said output means comprises a driving transistor for cycling said signal means.

14. A fuel control device as set forth in claim 13 wherein said sensing means comprises a field effect transistor having a gate that receives said signal means.

15. A fuel control device as set forth in claim 14 wherein said driving transistor has a collector electrically interconnected to said gate of said field effect transistor and has a gate electrically interconnected to said microcomputer means so as to be modulated thereby.

16. A fuel control device as set forth in claim 12 wherein said microcomputer means is operatively interconnected to said sensing means and has burner control means to maintain a flow of fuel to said burner means as long as said sensing means is detecting flame at said burner means.

17. A fuel control device as set forth in claim 12 wherein said microcomputer means is operatively interconnected to said sensing means and has quantifying means to determine the value of the electrical current of said signal means being sent to said sensing means and thereby determine the size of the flame at said burner means at that time.

18. A fuel control device as set forth in claim 17 wherein said microcomputer means has means to store the determined values of the electrical currents of said signal means for future use of such information.

19. In a method of making a fuel control system for a burner means and comprising the steps of providing an ignition means for igniting fuel issuing from said burner means, providing flame detecting means for detecting flame at said burner means, forming said flame detecting means to comprise a sensing means for receiving an electrical signal means caused by flame rectification at said burner means, and forming said flame detecting means to comprise an output means for cycling said signal means to said sensing means in an on and off manner in each cycle of operation of said output means, the improvement comprising the step of forming said control system to have modulating means for modulating the on time and the off time of said output means in each cycle of operation thereof.

20. In a method of making a fuel control device for controlling the operation of a burner means and comprising the steps of providing an ignition means for igniting fuel issuing from said burner means, providing flame detecting means for detecting flame at said burner means, forming said flame detecting means to comprise a sensing means for receiving an electrical signal means caused by flame rectification at said burner means, and forming said flame detecting means to comprise an output means for cycling said signal means to said sensing means in an on and off manner in each cycle of operation of said output means, the improvement comprising the step of forming said control device to have modulating means for modulating the on time and the off time of said output means in each cycle of operation thereof.

21. In a method of operating a fuel control system for a burner means, said system comprising ignition means for igniting fuel issuing from said burner means, and flame detecting means for detecting flame at said burner means, said flame detecting means comprising a sensing means for receiving an electrical signal means caused by flame rectification at said burner means, and an output means for cycling said signal means to said sensing means in an on and off manner in each cycle of operation of said output means, the improvement comprising the step of modulating the on time and the off time of said output means in each cycle of operation thereof.

22. A method as set forth in claim 21 and comprising the step of determining the value of the electrical current of said signal means being sent to said sensing means and thereby determining the size of the flame at said burner means at that time.

* * * * *